US008770543B2

(12) United States Patent
Huynh

(10) Patent No.: US 8,770,543 B2
(45) **Date of Patent: *Jul. 8, 2014**

(54) PROPORTIONAL POPPET VALVE WITH INTEGRAL CHECK VALVES

(75) Inventor: Tam Chi Huynh, Richfield, MN (US)

(73) Assignee: Eaton Corporation, Cleveland, OH (US)

( * ) Notice: Subject to any disclaimer, the term of this patent is extended or adjusted under 35 U.S.C. 154(b) by 277 days.

This patent is subject to a terminal disclaimer.

(21) Appl. No.: 13/183,008

(22) Filed: Jul. 14, 2011

(65) Prior Publication Data

US 2013/0014837 A1 Jan. 17, 2013

(51) Int. Cl.
*F15B 13/00* (2006.01)

(52) U.S. Cl.
USPC ..... 251/29; 91/445; 91/446

(58) Field of Classification Search
USPC ..... 137/494–495; 91/445–447; 251/29
See application file for complete search history.

(56) References Cited

U.S. PATENT DOCUMENTS

| | | | | |
|---|---|---|---|---|
| 2,480,712 | A | 8/1949 | Carbon | |
| 3,024,801 | A | 3/1962 | Carls | |
| 3,189,046 | A | 6/1965 | Callahan et al. | |
| 3,593,741 | A * | 7/1971 | Odenthal et al. | 137/495 |
| 3,862,738 | A | 1/1975 | Stumpmeier | |
| 4,149,565 | A | 4/1979 | Jennings et al. | |
| 4,311,296 | A | 1/1982 | Scheffel | |
| 4,340,086 | A | 7/1982 | Hemm et al. | |
| 4,478,245 | A | 10/1984 | Bender | |
| 4,585,206 | A | 4/1986 | Itoh | |
| RE32,644 | E | 4/1988 | Brundage et al. | |
| 4,779,836 | A | 10/1988 | Marklund | |
| 4,813,447 | A | 3/1989 | Ichiryu et al. | |
| 4,848,721 | A | 7/1989 | Chudakov | |
| 4,905,959 | A | 3/1990 | Andersson | |
| 4,958,553 | A | 9/1990 | Ueno | |
| 5,036,877 | A | 8/1991 | Distler et al. | |
| 5,072,752 | A | 12/1991 | Kolchinsky | |

(Continued)

FOREIGN PATENT DOCUMENTS

| | | | |
|---|---|---|---|
| JP | 2000337304 | A | 12/2000 |
| WO | WO 00/73665 | A1 | 12/2000 |

OTHER PUBLICATIONS

International Search Report and Written Opinion mailed Feb. 17, 2011 from PCT/IB2010/001915.

(Continued)

*Primary Examiner* — John Rivell
*Assistant Examiner* — David Colon Morales
(74) *Attorney, Agent, or Firm* — Merchant & Gould P.C.

(57) ABSTRACT

A poppet valve assembly includes a body and first and second check valves. The body includes opposing first and second axial end portions. The first end portion has a first circumferential surface, a first end surface, and a tapered surface, which seals with a main valve seat. The second axial end portion defines at least one metering slot. The body defines first and second internal passages. The first internal passage includes an opening in the first end surface, is in fluid communication with one of the metering slots, and has a first check valve seat. The second internal passage includes an opening in the first circumferential surface, is in fluid communication with one of the metering slot, and has a second check valve seat. The first and second check valves are disposed in the respective internal passages and are adapted for sealing engagement with the respective check valve seats.

13 Claims, 11 Drawing Sheets

(56) References Cited

U.S. PATENT DOCUMENTS

| | | | | |
|---|---|---|---|---|
| 5,097,746 | A | 3/1992 | Asaoka et al. | |
| 5,101,858 | A | 4/1992 | Klotz | |
| 5,137,254 | A | 8/1992 | Aardema et al. | |
| 5,170,692 | A | 12/1992 | Lonnemo | |
| 5,174,544 | A | 12/1992 | Emanie | |
| 5,207,059 | A | 5/1993 | Schexnayder | |
| 5,400,816 | A | 3/1995 | Gerstenberger | |
| 5,421,545 | A | 6/1995 | Schexnayder | |
| 5,568,759 | A | 10/1996 | Aardema | |
| 5,645,263 | A | 7/1997 | Aardema | |
| 6,038,957 | A | 3/2000 | Ertmann et al. | |
| 6,047,944 | A | 4/2000 | Hajek, Jr. | |
| 6,073,444 | A | 6/2000 | Horton et al. | |
| 6,089,528 | A | 7/2000 | Hajek, Jr. et al. | |
| 6,109,284 | A | 8/2000 | Johnson | |
| 6,131,606 | A | 10/2000 | O'Neill | |
| 6,206,044 | B1 | 3/2001 | Gluf, Jr. | |
| 6,293,180 | B1 | 9/2001 | Morisako et al. | |
| 6,296,015 | B1 | 10/2001 | Morisako et al. | |
| 6,557,822 | B1 | 5/2003 | Yoshino | |
| 6,682,316 | B1 | 1/2004 | Böke | |
| 6,691,510 | B2 | 2/2004 | Kariya et al. | |
| 7,028,708 | B1 | 4/2006 | Langenfeld et al. | |
| 7,258,134 | B1 | 8/2007 | Langenfeld et al. | |
| 7,621,211 | B2 * | 11/2009 | Ma et al. | 91/446 |
| 7,793,912 | B2 | 9/2010 | Andoh | |
| 7,931,112 | B2 | 4/2011 | Gehlhoff | |
| 2002/0157529 | A1 | 10/2002 | Kariya et al. | |
| 2004/0195532 | A1 * | 10/2004 | Barber et al. | 251/30.02 |
| 2005/0242310 | A1 | 11/2005 | Takiguchi et al. | |
| 2006/0248883 | A1 | 11/2006 | Gehlhoff | |
| 2007/0290152 | A1 | 12/2007 | Ma et al. | |
| 2009/0050222 | A1 | 2/2009 | Jackson et al. | |
| 2009/0218161 | A1 | 9/2009 | Cadman et al. | |
| 2010/0155633 | A1 | 6/2010 | Pfaff | |
| 2011/0030818 | A1 | 2/2011 | Huynh | |

OTHER PUBLICATIONS

EPV16 Series Valvistor Proportional Flow Controls, Eaton Corporation, Oct. 1999, 16 pages.

* cited by examiner

PROPORTIONAL POPPET VALVE WITH INTEGRAL CHECK VALVES

TECHNICAL FIELD

This disclosure relates to valve assemblies for controlling fluids.

BACKGROUND

Valve assemblies are used in various applications including off-highway agriculture and construction equipment (for example, wheel loaders, skid steers, combines, etc.). In some applications, valve assemblies are used to control the amount of fluid provided to implements such as buckets or booms. The valve assembly may be used to increase flow to the load or may be used for some degree of load holding, such that the implements can hold a load (for example, extended boom, bucket, etc.) for an extended period of time.

SUMMARY

A poppet valve assembly in provided. The poppet valve assembly includes a body, a first check valve, and a second check valve. The body includes a first axial end portion having a first circumferential surface, a first end surface, and a tapered surface. The tapered surface is configured for sealing engagement with a main valve seat. The body also includes a second axial end portion, which is opposite the first axial end portion and defines at least one metering slot.

A first internal passage and a second internal passage are defined by the body. The first internal passage includes an opening in the first end surface, is in fluid communication with the metering slot, and has a first check valve seat. The second internal passage includes an opening in the first circumferential surface, is in fluid communication with the metering slot, and has a second check valve seat.

The first check valve is disposed in the first internal passage and is adapted for sealing engagement with the first check valve seat. The second check valve disposed is in the second internal passage and is adapted for sealing engagement with the second check valve seat.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
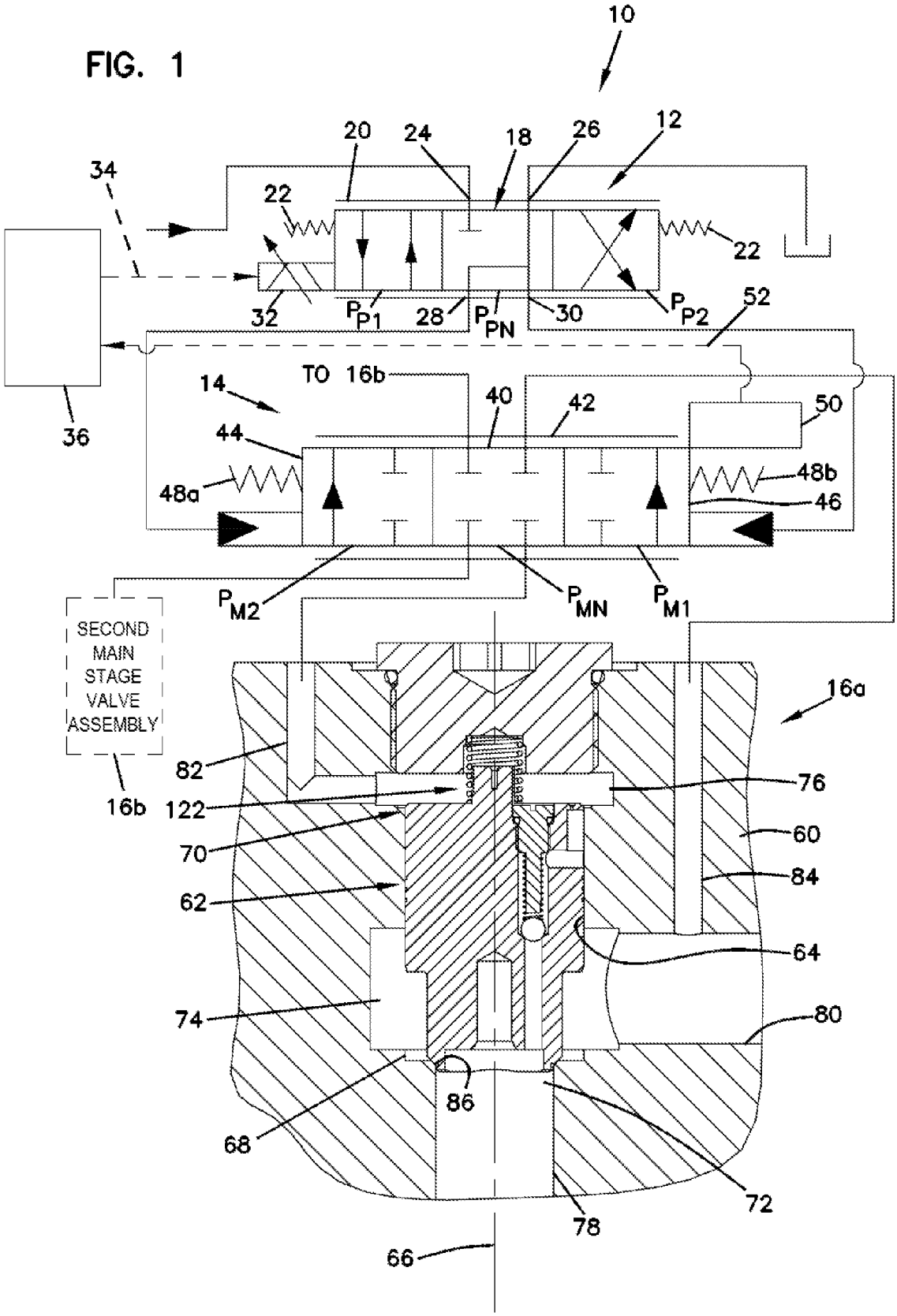
FIG. 1 is a schematic representation of a valve assembly having illustrative features or aspects in accordance with the principles of the disclosure, and shown partially in cross section.

Referring now to FIG. 1, a valve assembly, generally designated 10, is shown. In the embodiment shown, the valve assembly 10 includes three stages: a pilot stage valve assembly 12, a middle stage valve assembly 14 and a first main stage valve assembly 16*a*.

In the embodiment shown, the pilot stage valve assembly 12 is a proportional valve that includes a pilot stage spool valve 18 and a housing 20. The pilot stage spool valve 18 is disposed in a bore of the housing 20 such that the pilot stage spool valve 18 is axially slidable in the bore of the housing 20.

The pilot stage valve assembly 12 further includes a plurality of centering springs 22. The plurality of centering springs 22 is adapted to center the pilot stage spool valve 18 in the bore of the housing 20.

In the embodiment shown, the pilot stage valve assembly 12 is a four-way valve. The pilot stage valve assembly 12 includes a fluid inlet port 24, a fluid return port 26, a first control port 28 and a second control port 30. In another aspect of the present disclosure, the pilot stage valve assembly 12 is a three-position valve. The pilot stage valve assembly 12 includes a neutral position $P_{PN}$, a first position $P_{P1}$ and a second position $P_{P2}$.

In the neutral position $P_{PN}$, the first and second control ports 28, 30 are in fluid communication with the fluid return port 26. In the first position $P_{P1}$, the first control port 28 is in fluid communication with the fluid inlet port 24 while the second control port 30 is in fluid communication with the fluid return port 26. In the second position $P_{P2}$, the first control port 28 is in fluid communication with the fluid return port 26 while the second control port 30 is in fluid communication with the fluid inlet port 24.

As a proportional valve, the axial position of the pilot stage spool valve 18 in the bore of the housing 20 controls the amount of fluid that passes through the pilot stage valve assembly 12. The pilot stage valve assembly 12 includes an electronic actuator 32 that is adapted to axially move the pilot stage spool valve 18 in the bore of the housing 20 between the neutral position $P_{PN}$ and the first and second positions $P_{P1}$, $P_{P2}$. In the embodiment shown, the electronic actuator 32 is a voice coil.

The electronic actuator 32 is actuated in response to an electronic signal 34 (shown as a dashed lined in FIG. 1) received from a microprocessor 36. In the embodiment shown, the microprocessor 36 provides the electronic signal 34 in response to various input signals.

The first and second control ports 28, 30 of the pilot stage valve assembly 12 are in fluid communication with the middle stage valve assembly 14. In the embodiment shown, the middle stage valve assembly 14 is a three-position, four-way proportional valve. In another aspect of the present disclosure, the middle stage valve assembly 14 is a two-position, two-way proportional valve.

The middle stage valve assembly 14 includes a middle stage spool valve 40 and a housing 42. The middle stage spool valve 40 is disposed in a bore of the housing 42 such that the middle stage spool valve 40 is axially slidable in the bore of the housing 42.

The middle stage spool valve 40 includes a first axial end 44 and an oppositely disposed second axial end 46. A first spring 48*a* acts on the first axial end 44 of the middle stage spool valve 40 while a second spring 48*b* acts on the second axial end 46. The first and second springs 48*a*, 48*b* are adapted to center the middle stage spool valve 40 in the bore of the housing 42.

The axial position of the middle stage spool valve 40 in the bore of the housing 42 is controlled by fluid pressure acting on one of the first and second axial ends 44, 46. In the embodiment shown, the first control port 28 of the pilot stage valve assembly 12 is in fluid communication with the first axial end 44 of the middle stage spool valve 40 while the second control port 30 of the pilot stage valve assembly 12 is in fluid communication with the second axial end 46.

The middle stage valve assembly 14 further includes a position sensor 50. In the embodiment shown, the position sensor 50 is a linear variable displacement transducer (LVDT). However, the position sensor 50 may be any other, suitable position sensor. The position sensor 50 senses the position of the middle stage spool valve 40 in the bore of the housing 42. The position sensor 50 sends a signal 52 to the microprocessor 36, which uses the positional data from the position sensor 50 to actuate the electronic actuator 32 of the pilot stage valve assembly 12. The positions of the middle stage valve assembly 14 will be described in greater detail subsequently.

In the embodiment shown, the middle stage valve assembly 14 is in selective fluid communication with the first main stage valve assembly 16*a*. In another aspect of the present disclosure, the middle stage valve assembly 14 is in selective fluid communication with the first main stage valve assembly 16*a* and a second main stage valve assembly 16*b*, where the second main stage valve assembly 16*b* is substantially similar in structure to the first main stage valve assembly 16*a*. For ease of description purposes, the second main stage valve assembly 16*b* will not be separately described herein as the second main stage valve assembly 16*b* is substantially similar in structure to the first main stage valve assembly 16*a*.

Figure 2:
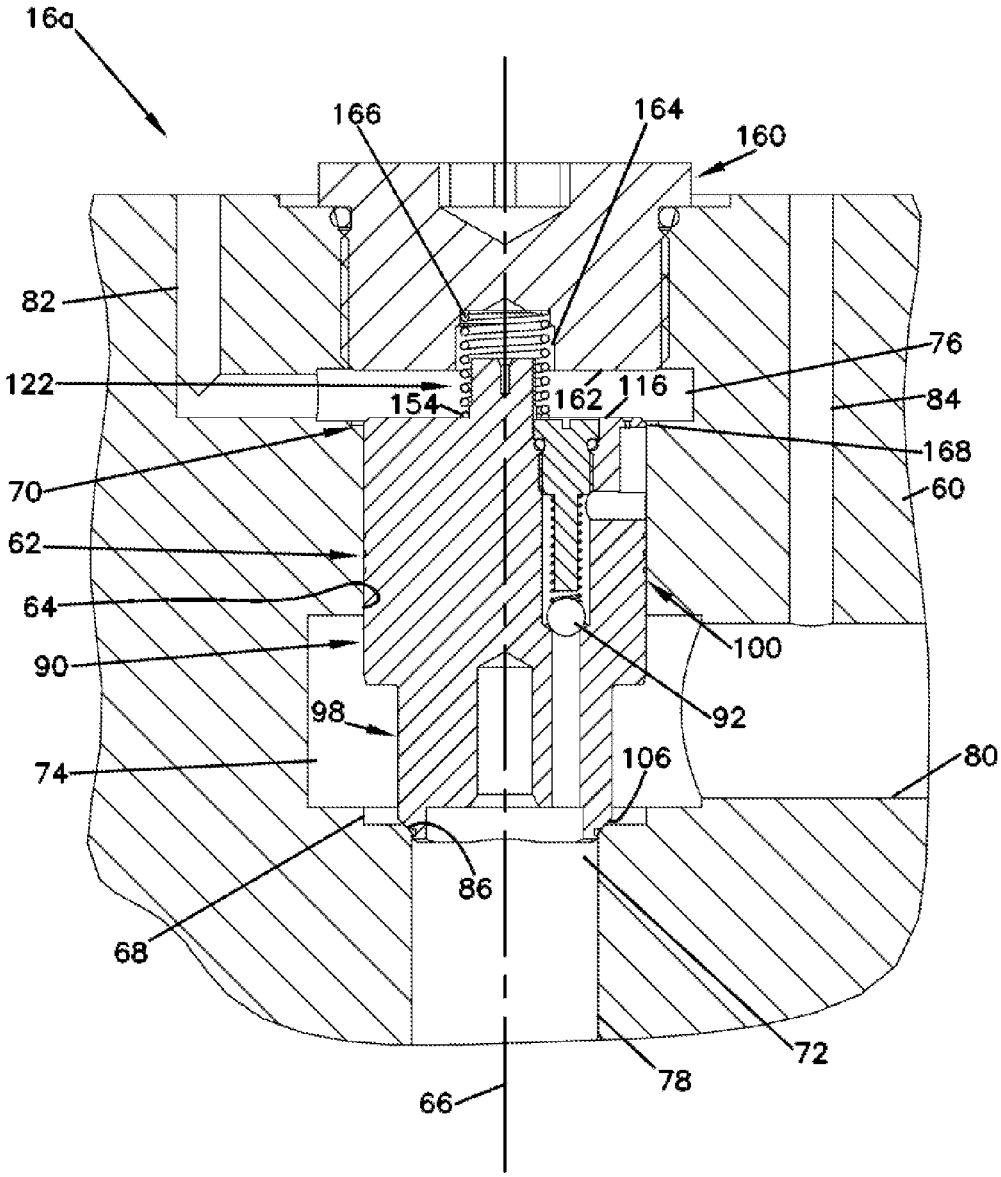
FIG. 2 is a schematic fragmentary, cross-sectional view of a main stage valve assembly suitable for use in the valve assembly of FIG. 1.

Referring now to FIGS. 1 and 2, the first main stage valve assembly 16*a* will be described. The first main stage valve assembly 16*a* includes a valve housing 60 and a poppet valve assembly, generally designated 62.

The valve housing 60 defines a valve bore 64 having a central longitudinal axis 66. The valve bore 64 is adapted to receive the poppet valve assembly 62. The poppet valve assembly 62 is adapted to move in an axial direction in the valve bore 64 along the central longitudinal axis 66.

The valve bore 64 includes a first end portion 68 and an oppositely disposed second end portion 70. The valve bore 64 defines a first cavity 72, a second cavity 74 and a load holding cavity 76. The first cavity 72 is disposed at the first end portion 68 of the valve bore 64. The second cavity 74 is disposed between the first and second end portions 68, 70. The load holding cavity 76 is disposed at the second end portion 70.

The valve housing 60 further defines a first fluid passage 78 in fluid communication with the first cavity 72 of the valve bore 64, a second fluid passage 80 in fluid communication with the second cavity 74 of the valve bore 64 and a third fluid passage 82 in fluid communication with the load holding cavity 76 of the valve bore 64. The valve housing 60 further defines a fourth fluid passage 84. The fourth fluid passage 84 is in fluid communication with the second fluid passage 80 and in selective fluid communication with the third fluid passage 82 through the middle stage valve assembly 14. In the embodiment shown, the first fluid passage 78 is an inlet fluid passage while the second fluid passage 80 is an outlet fluid passage.

The valve bore 64 includes a valve seat 86. The valve seat 86 is disposed at the first end portion 68 of the valve bore 64.

The valve seat 86 of the valve bore 64 is adapted for selective sealing engagement with the poppet valve assembly 62. In the embodiment shown, the valve seat 86 is tapered such that the valve seat 86 includes an inner diameter that decreases as the distance along the central longitudinal axis 66 from the valve seat 86 to the second end portion 70 increases. In another aspect of the present disclosure, the valve seat 86 is generally frusto-conical in shape.

The poppet valve assembly 62 includes a poppet valve, generally designated 90, and a check valve 92. In the embodiment shown, the check valve 92 is disposed in the poppet valve 90.

Referring now to FIGS. 3-6, the poppet valve 90 is shown. The poppet valve 90 includes a poppet body 94, having a central longitudinal axis 96 that extends through the center of the poppet body 94. The poppet body 94 includes a first axial end portion 98 and an oppositely disposed second axial end portion 100. In the embodiment shown, the first axial end portion 98 has an outer diameter $D_1$ that is less than an outer diameter $D_2$ of the second axial end portion 100.

The first axial end portion 98 includes a first end surface 102 and a first circumferential surface 104. The first circumferential surface 104 is generally cylindrical in shape. In the embodiment shown, the first circumferential surface 104 includes a tapered surface 106. The tapered surface 106 is adapted for selective sealing engagement with the valve seat 86 of the valve bore 64. The tapered surface 106 is disposed adjacent to the first end surface 102. The tapered surface 106 is generally frusto-conical in shape and has an outer diameter that increases as the axial distance from the first end surface 102 to the tapered surface 106 increases.

In the embodiment shown, the first axial end portion 98 defines a circumferential groove 108. In the depicted embodiment of FIGS. 1-6, the circumferential groove 108 is disposed between the first end surface 102 and the tapered surface 106. In the embodiment shown, the circumferential groove 108 improves the grindability of the tapered surface 106 during the manufacturing process of the poppet valve 90.

In another aspect of the present disclosure, the first axial end portion 98 further defines a cavity 112. The cavity 112 includes an opening 114 in the first end surface 102.

The second axial end portion 100 includes a second end surface 116 and a second circumferential surface 118. In the embodiment shown, the second end surface 116 includes a spring guide 120. The spring guide 120 is generally cylindrical in shape and extends outwardly from a central location on the second end surface 116. An outer diameter of the spring guide 120 is sized to be smaller than an inner diameter of a spring 122 (best shown in FIG. 2) such that the spring guide 120 fits within a portion of the inner diameter of the spring 122. In the embodiment shown, the spring 122 is a coil spring.

The second circumferential surface 118 is generally cylindrical in shape. In the embodiment shown, the second circumferential surface 118 defines a plurality of grooves 123. In the depicted embodiment, there are three grooves 123 defined by the second circumferential surface 118. The grooves 123 extend around the second circumferential surface 118 and are adapted to pressure balance the poppet valve 90 in the valve bore 64.

The second circumferential surface 118 defines a hole 124 that extends into the poppet body 94 from the second circumferential surface 118 in a radial direction. The second circumferential surface 118 further defines a metering slot 126 that extends outwardly in an axial direction from the hole 124 toward the second end surface 116.

The poppet body 94 of the poppet valve 90 defines a passage 128. The passage 128 is adapted to provide fluid communication between the first fluid passage 78 and the load holding cavity 76. As will be described in greater detail subsequently, the flow through the passage 128 and the flow through the middle stage valve assembly 14 cooperatively determine the axial position of the poppet valve assembly 62 in the valve bore 64 of the housing 60.

The passage 128 extends in a generally longitudinal direction through the first and second end surfaces 102, 116. In the embodiment shown, the passage 128 is generally parallel to the central longitudinal axis 96 of the poppet body 94. In another aspect of the present disclosure, the passage 128 is offset from the central longitudinal axis 96 of the poppet body 94. In another aspect of the present disclosure, the passage 128 is generally aligned with the central longitudinal axis 96 of the poppet body 94.

The passage 128 includes a first portion 130 and a second portion 132. The first portion 130 includes an opening 133 defined by the first end surface 102 and extends into the poppet body 94 of the poppet valve 90 in a first longitudinal direction from the cavity 112 of the first axial end portion 98 while the second portion 132 extends into the poppet body 94 in an opposite second longitudinal direction from the second end surface 116. In the embodiment shown, the first and second portions 130, 132 are aligned.

The first portion 130 includes an inner diameter that is less than an inner diameter of the second portion 132. The first and second portions 130, 132 of the passage 128 cooperatively define a check valve seat 134. The check valve seat 134 is adapted for selective sealing engagement with the check valve 92, which is adapted to provide one-way flow through the passage 128. In the embodiment shown, the check valve seat 134 includes a generally frusto-conical surface that has an inner diameter that decreases as a distance from the second end surface 116 increases. In another aspect of the present disclosure, the check valve seat 134 is generally perpendicular to a longitudinal axis that extends through the passage 128.

The first portion 130 of the passage 128 is in fluid communication with the cavity 112. The second portion 132 of the passage 128 is in fluid communication with the metering slot 126. In the embodiment shown, the fluid communication between the metering slot 126 and the second portion 132 of the passage 128 is established through the hole 124, which extends from the second circumferential surface 118 to the second portion 132 of the passage 128.

Figure 6:
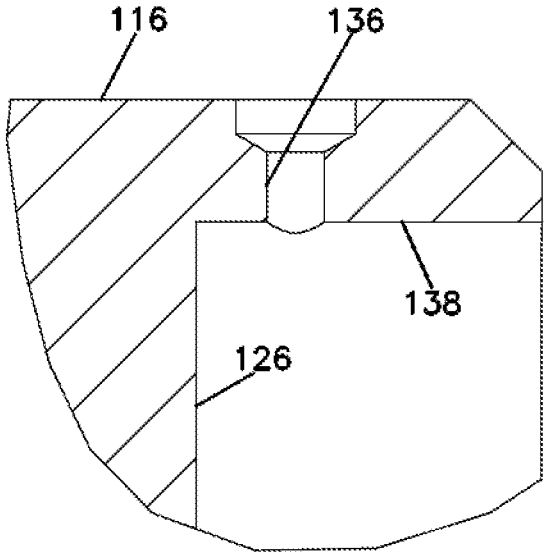
FIG. 6 is a schematic enlarged fragmentary view of an orifice of the poppet valve of FIG. 3.

Referring now to FIG. 6, the poppet valve 90 further defines an orifice 136. The orifice 136 extends through the second end surface 116 and through an axial end 138 of the metering slot 126. An inner diameter of the orifice 136 is adapted to provide limited fluid communication between the metering slot 126 and the load holding cavity 76 when the poppet valve assembly 62 is in a seated position (shown in FIGS. 1 and 2).

Figure 7:
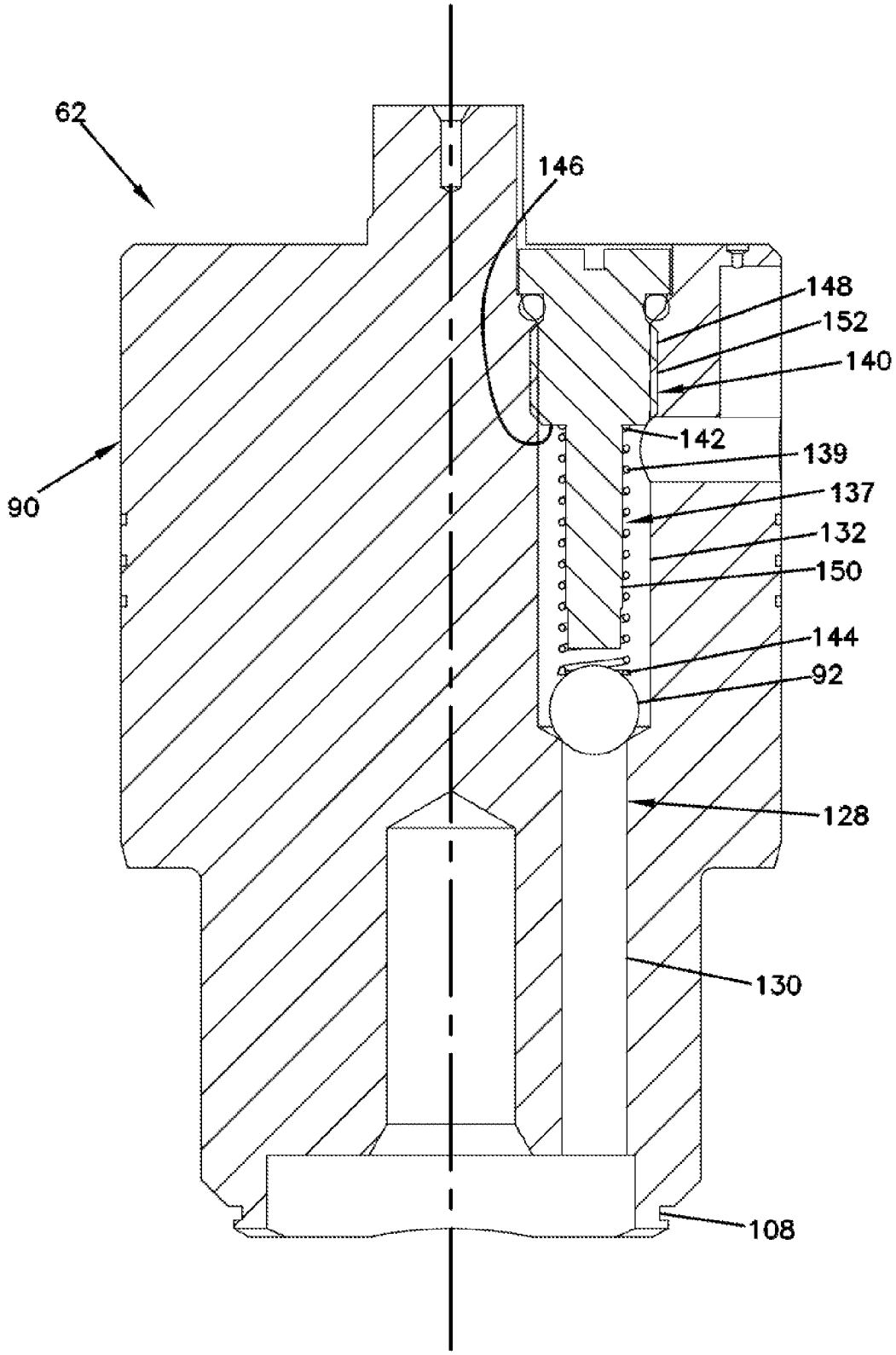
FIG. 7 is a schematic cross-sectional view of the poppet valve assembly shown within the main stage valve assembly of FIG. 2.

Referring now to FIG. 7, the assembly of the poppet valve assembly 62 will be described. The check valve 92 is disposed in the second portion 132 of the passage 128. A plug assembly 137 is then inserted into the second portion 132 of the passage 128. The plug assembly 137 includes a spring 139 and a plug 140.

The spring 139 includes a first end 142 and an oppositely disposed second end 144. The first end 142 of the spring 139 engages a spring seat 146 on the plug 140 while the second end 144 engages the check valve 92. The disposition of the spring 139 between the plug 140 and the check valve 92 biases the check valve 92 into the check valve seat 134.

The plug 140 of the plug assembly 137 includes a first axial portion 148 and a second axial portion 150. The first axial portion 148 includes the spring seat 146 and defines a plurality of external threads on an outer circumferential surface 152. The external threads of the first axial portion 148 are adapted for engagement with a plurality of internal threads defined by the second portion 132 of the passage 128.

The second axial portion 150 extends outwardly from the first axial portion 148. An outer diameter of the second axial portion 150 is less than an outer diameter of the first axial portion 148 and is less than the inner diameter of the spring 139. The second axial portion 150 is adapted to prevent the check valve 92 from moving too great a distance from the check valve seat 134.

The plug 140 is inserted into the passage 128 such that the spring 139 circumferentially surrounds the second axial portion 150 of the plug 140. The plug 140 is tightened into the second portion 132 of the passage 128.

Referring now to FIG. 2, the assembly of the first main stage valve assembly 16*a* will be described. The poppet valve assembly 62 is inserted into the valve bore 64 of the housing 60 so that the first axial end portion 98 of the poppet valve 90 is disposed in the first end portion 68 of the valve bore 64 of the housing 60 and the second axial end portion 100 of the poppet valve 90 is disposed in the second end portion 70 of the valve bore 64.

With the poppet valve assembly 62 disposed in the valve bore 64, the spring 122 is inserted into the second end portion 70 of the valve bore 64. The spring 122 is inserted so that a first end 154 of the spring 122 abuts the second end surface 116 of the second axial end portion 100 of the poppet valve 90 while the inner diameter of the spring 122 circumferentially surrounds the spring guide 120 of the second axial end portion 100 of the poppet valve 90.

An end plug 160 in then inserted into the second end portion 70 of the valve bore 64 of the housing 60. The end plug 160 includes an axial end 162. The axial end 162 defines a spring cavity 164. The spring cavity 164 is adapted to receive a second end 166 of the spring 122.

In the embodiment shown, the end plug 160 includes a plurality of external threads. The external threads are adapted for threaded engagement with a plurality of internal threads defined by the second end portion 70 of the valve bore 64. As the end plug 160 is threaded into the second end portion 70 of the valve bore 64, the spring 122 compresses between the second axial end portion 100 of the poppet valve 90 and the end plug 160. This compression of the spring 122 between the second axial end portion 100 of the poppet valve 90 and the end plug 160 biases the poppet valve 90 into the valve seat 86.

Referring now to FIG. 1, the middle stage valve assembly 14 includes a neutral position $P_{MN}$, a first position $P_{M1}$, and a second position $P_{M2}$. In the neutral position $P_{MN}$, the middle stage valve assembly 14 is adapted to selectively block fluid communication between the load holding cavity 76 of the valve assembly 16*a* and the second fluid passage 80 of the valve assembly 16*a*. With fluid communication between the load holding cavity 76 and the second fluid passage 80 blocked, the poppet valve assembly 62 is hydraulically locked in a seated position in which the tapered surface 106 is seated against the valve seat 86. With the tapered surface 106 seated against the valve seat 86, the fluid communication between the first fluid passage 78 and the second fluid passage 80 is blocked.

In the first position $P_{M1}$, the middle stage valve assembly 14 is adapted to provide fluid communication between the load holding cavity 76 and the second fluid passage 80 of the first main stage valve assembly 16*a*. In this position, the poppet valve assembly 62 can move axially in the valve bore 64. If the flow through the passage 128 is less than the flow through the middle stage valve assembly 14, the tapered surface 106 of the poppet valve assembly 62 moves in a first axial direction away from the valve seat 86 causing a clearance between the tapered surface 106 and the valve seat 86. As this clearance increases, the amount of fluid communicated between the first fluid passage 78 and the second fluid passage 80 increases. If the flow through the passage 128 is equal to the flow through the middle stage valve assembly 14, the axial position of the poppet valve assembly 62 is held at a constant axial position. If the flow through the passage 128 is greater than the flow through the middle stage valve assembly 14, the poppet valve assembly 62 moves in a second axial direction toward the valve seat 86 causing the clearance between the tapered surface 106 and the valve seat 86 to decrease. As this clearance decreases, the amount of fluid communicated between the first fluid passage 78 and the second fluid passage 80 decreases.

The amount of flow through the passage 128 is governed primarily by the size of an opening created between the metering slot 126 and a recess 168 in the second end portion 70 of the valve bore 64. As the opening between the metering slot 126 and the recess 168 increases, the amount of flow through the passage 128 increases. In the seated state, the metering slot 126 of the poppet valve 90 is completely covered by the valve bore 64. In this situation, fluid can flow through the passage 128 into the load holding cavity 76 through the orifice 136 until the opening between the metering slot 126 and the recess 168 is present.

In the embodiment shown, the middle stage valve assembly 14 is a proportional valve assembly. As a result, the amount of fluid that flows through the middle stage valve assembly 14 is proportional to the axial position of the middle stage spool valve 40 in the bore of the housing 42. As the middle stage spool valve 40 moves closer to the first position $P_{M1}$, the amount of fluid that passes through the middle stage valve assembly 14 increases.

In the second position $P_{M2}$, the middle stage valve assembly 14 is in fluid communication with a load holding cavity and second fluid passage of the second main stage valve assembly 16*b* while fluid communication between the load holding cavity 76 and the second fluid passage 80 of the first main stage valve assembly 16*a* is blocked. As the second main stage valve assembly 16*b* is similar in structure to the first main stage valve assembly 16*a*, the operation of the middle stage valve assembly 14 in the second position $P_{M2}$ is similar to the operation of the middle stage valve assembly 14 in the first position $P_{M1}$.

Referring now to FIGS. 1-7, the operation of the valve assembly 10 will be described. In response to an input signal and the signal 52 from the positional sensor 50, the microcontroller 36 sends an electronic signal 34 to the electronic actuator 32 of the pilot stage valve assembly 12. In the present scenario, the pilot stage valve assembly 12 is actuated to the second position $P_{P2}$. In the second position $P_{P2}$, the second control port 30 of the pilot stage valve assembly 12 is in fluid communication with the fluid inlet port 24 while the first control port 28 is in fluid communication with the fluid return port 26.

With the pilot stage valve assembly 12 in the second position $P_{P2}$, fluid passes through the pilot stage valve assembly 12 to the second axial end 46 of the middle stage spool valve 40 while any fluid acting on the first axial end 44 of the middle stage spool valve 40 is drained. The fluid acting on the second axial end 46 of the middle stage spool valve 40 causes the middle stage valve assembly 14 to shift toward a first position $P_{M1}$. Note that some embodiments of the valve assembly 10 may not include the pilot stage valve assembly 12. In such a configuration, the middle stage valve assembly 14 may be controlled by means other than fluid pressure, including (without limitation) electronic control by solenoids or magnetic control. However, the operation of the middle stage valve assembly 14 relative to the first main stage valve assembly 16*a*, and the fluid communications therebetween, remains the substantially the same.

With the middle stage valve assembly 14 shifting toward the first position $P_{M1}$, the load holding cavity 76 of the main stage valve assembly 16*a* is in fluid communication with the second fluid passage 80. With the load holding cavity 76 of the main stage valve assembly 16*a* in fluid communication with the second fluid passage 80, fluid pressure acting on the first end surface 102 of the poppet valve 90 moves the poppet valve 90 along the central longitudinal axis 66 such that the tapered surface 106 of the poppet valve 90 is disengaged or unseated from the valve seat 86 of the valve bore 64. With the poppet valve 90 unseated from the valve seat 86, fluid communication is established between the first fluid passage 78 and the second fluid passage 80.

In another scenario, the pilot stage valve assembly 12 is positioned in the neutral position $P_{PN}$. In the neutral position $P_{PN}$, fluid is drained from each of the first and second axial ends 44, 46 of the middle stage spool valve 40 so that the middle stage valve assembly 14 is disposed in the neutral position $P_{MN}$. As previously provided, with the middle stage valve assembly 14 in the neutral position $P_{MN}$, the poppet valve assembly 62 is hydraulically locked in the seated position thereby blocking fluid communication between the first and second fluid passages 78, 80.

The check valve 92, which is integrally disposed in the poppet body 94 of the poppet valve 90, allows for one-way fluid communication between the first fluid passage 78 and the load holding cavity 76. In the embodiment shown, the check valve 92 prevents fluid from being communicated in a direction from the load holding cavity 76 to the first fluid passage 78. The check valve 92 is adapted to prevent leakage through the passage 128. Leakage flowing in the direction from the load holding cavity 76 to the first fluid passage 78 can result in the poppet valve assembly 62 being inadvertently unseated from the valve seat 86 while the middle stage valve assembly 14 is in the neutral position $P_{MN}$.

Figure 8A:
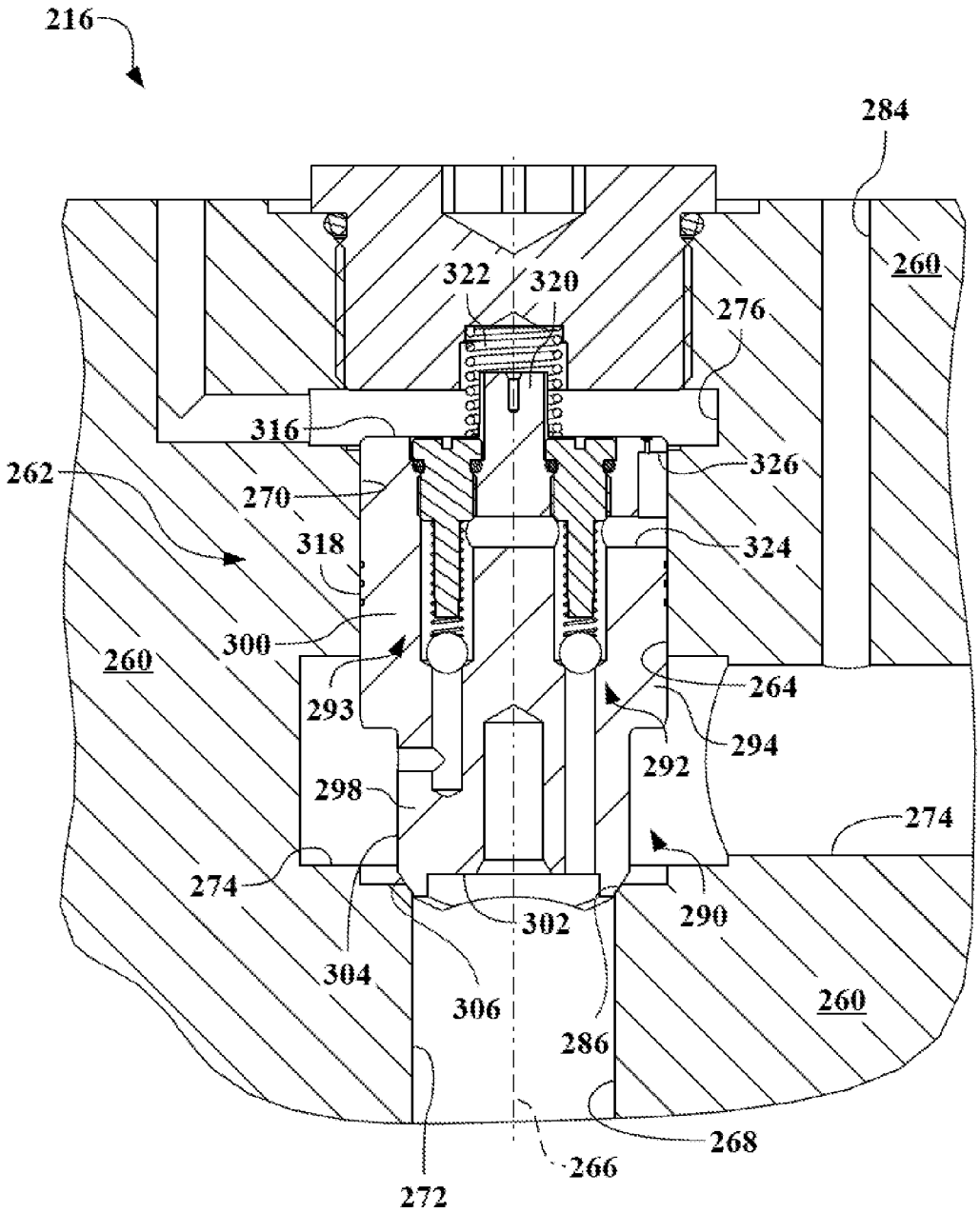
FIG. 8A is a schematic cross-sectional view of a main stage valve assembly including a poppet valve assembly having two check valves linked to a single orifice and metering slot.
Figure 8B:
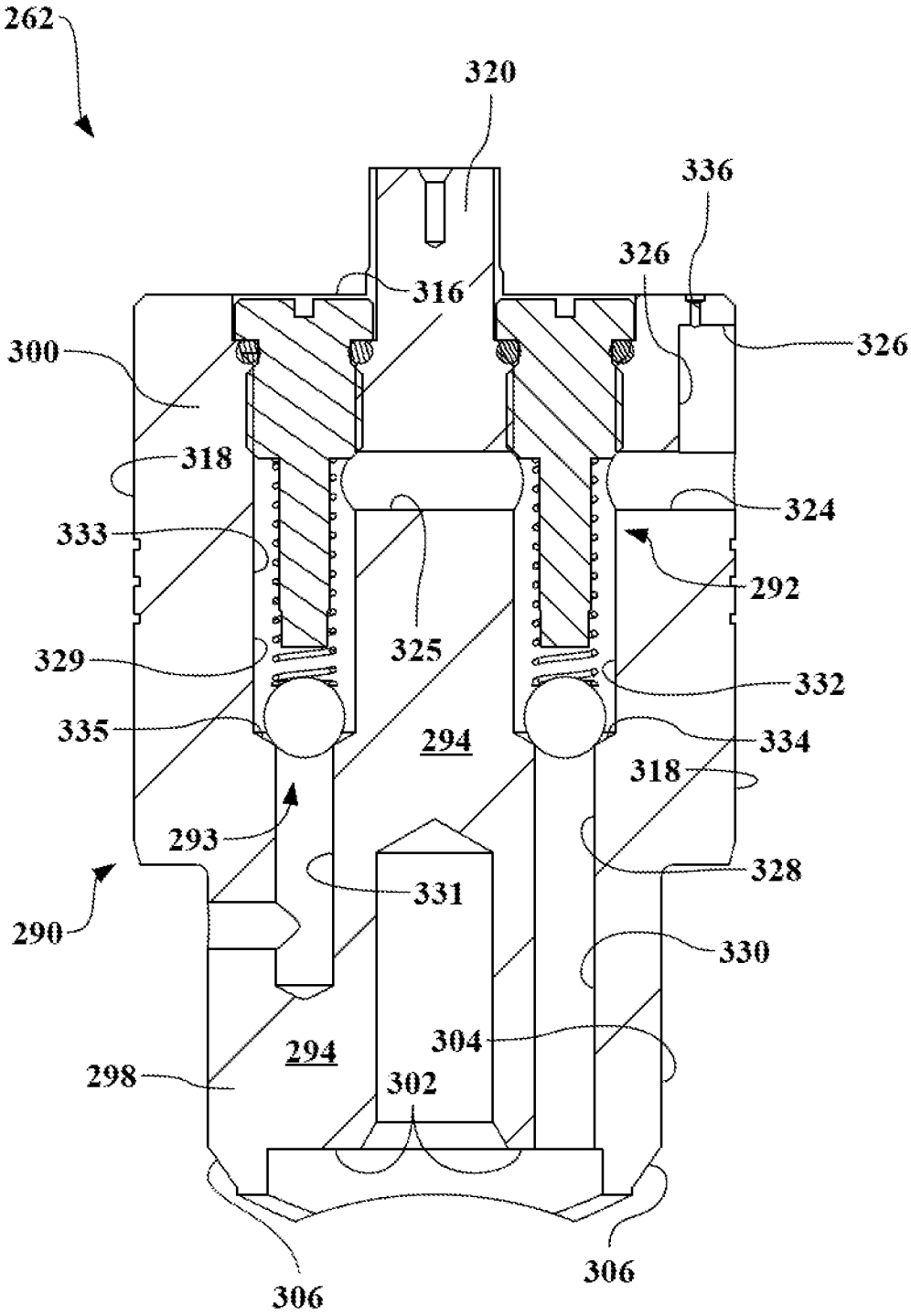
FIG. 8B is a schematic cross-sectional view of the poppet valve assembly shown in FIG. 8A.

Referring now to FIG. 8A and FIG. 8B, and with continued reference to FIGS. 1-7, there is shown a main stage valve assembly 216. The main stage valve assembly 216 includes a valve housing 260 and a poppet valve assembly 262. FIG. 8A shows the whole main stage valve assembly 216, and FIG. 8B shows a larger view of the poppet valve assembly 262.

Many of the features and aspects of the main stage valve assembly 216 are similar to the first main valve assembly 16*a* shown in FIGS. 1-2. Therefore, some of the similar features shown in FIGS. 8A and 8B may not be described in detail. Similarly, some of the features of the poppet valve assembly 262 are similar to the poppet valve assembly 62 shown in FIGS. 1-7, and may not be described in detail. Features and components shown in other figures may be incorporated and used with those shown in FIGS. 8A and 8B.

The valve housing 260 defines a valve bore 264 having a central longitudinal axis 266. The valve bore 264 is adapted to receive the poppet valve assembly 262. The poppet valve assembly 262 is adapted to move in an axial direction in the valve bore 264 along the central longitudinal axis 266.

The valve bore 264 includes a first end portion 268 and an oppositely disposed second end portion 270. The valve bore 264 defines a first fluid passage or first cavity 272, a second fluid passage or second cavity 274 and a third fluid passage or load holding cavity 276. The first cavity 272 is disposed at the first end portion 268 of the valve bore 264. The second cavity 274 is disposed between the first end portion 268 and the second end portion 270. The load holding cavity 276 is disposed adjacent to the second end portion 270.

The valve housing 260 further defines a fourth fluid passage 284. The fourth fluid passage 284 is in fluid communication with the second cavity 274 and in selective fluid communication with the load holding cavity 276 through a control valve (not shown), which may be similar to the middle stage valve assembly 14 shown in FIG. 1. The first cavity 272 may be an inlet fluid passage while the second cavity 274 may be an outlet fluid passage.

The valve bore 264 includes a valve seat 286. The valve seat 286 is disposed at the first end portion 268 of the valve bore 264. The valve seat 286 is generally disposed at the intersection of the first cavity 272 and the valve bore 264.

The valve seat 286 of the valve bore 264 is adapted for selective sealing engagement with the poppet valve assembly 262. The valve seat 286 shown in FIG. 8A is tapered such that the valve seat 286 includes an inner diameter that decreases as the distance along the central longitudinal axis 266 from the valve seat 286 to the second end portion 270 increases. The valve seat 286 may be generally frusto-conical in shape.

The poppet valve assembly 262 includes a poppet valve 290, a first check valve 292, and a second check valve 293. The first check valve 292 and the second check valve 293 are disposed within the poppet valve 290.

The poppet valve 290 includes a poppet body 294, which is substantially coaxial with the central longitudinal axis 266 that extends through the center of the valve bore 264. The poppet body 294 includes a first axial end portion 298 and an oppositely disposed second axial end portion 300. In the embodiment shown, the first axial end portion 298 has a first outer diameter that is less than a second outer diameter of the second axial end portion 300.

The first axial end portion 298 includes a first end surface 302 and a first circumferential surface 304. The first end surface 302 may be configured with many shapes and may be broken up into multiple surfaces that are perpendicular to the central longitudinal axis 266 and in fluid communication with the first cavity 272. The first circumferential surface 304 is generally cylindrical in shape. The first circumferential surface 304 includes a tapered surface 306, which is adapted for selective sealing engagement with the valve seat 286 of the valve bore 264. The tapered surface 306 is disposed adjacent to the first end surface 302. The tapered surface 306 may be generally frusto-conical in shape.

The second axial end portion 300 includes a second end surface 316 and a second circumferential surface 318. The second end surface 316 is perpendicular to the central longitudinal axis 266 and provides an opposing fluid pressure reaction surface to the first end surface 302. As shown, the second end surface 316 may include a spring guide 320. The spring guide 320 is generally cylindrical in shape and extends outwardly from a central location on the second end surface 316. An outer diameter of the spring guide 320 is sized to be smaller than an inner diameter of a spring 322, such that the spring guide 320 fits within a portion of the inner diameter of the spring 322. The second circumferential surface 318 is also generally cylindrical in shape.

The second circumferential surface 318 defines a hole 324 that extends into the poppet body 294 from the second circumferential surface 318 in a radial direction. The second circumferential surface 318 further defines a metering slot 326 that extends outwardly in an axial direction from the hole 324 toward the second end surface 316. In the poppet valve 290 shown, the metering slot 326 does not intersect the second end surface 316.

The poppet body 294 of the poppet valve 290 defines a first internal passage 328. The first internal passage 328 is configured to selectively provide fluid communication between the first cavity 272 (adjacent the first end surface 302) and the load holding cavity 276 (adjacent the second end surface 316). Fluid flow through the first internal passage 328 and flow through the control valve cooperatively determine the axial position of the poppet valve assembly 262 in the valve bore 264 of the valve housing 260.

The first internal passage 328 extends in a generally longitudinal direction between the first end surface 302 and the second end surface 316. In the poppet valve 290 shown, the first internal passage 328 is generally parallel to the central longitudinal axis 266 of the poppet body 294, and is offset from the central longitudinal axis 266.

The first internal passage 328 includes a first portion 330 and a second portion 332. The first portion 330 extends to the first end surface 302 and is in fluid communication with the first cavity 272. The second portion 332 extends into the poppet body 294 from the second end surface 316.

The first portion 330 includes an inner diameter that is less than an inner diameter of the second portion 332. The first and second portions 330, 332 of the first internal passage 328 cooperatively define a first check valve seat 334. The first check valve seat 334 is configured for selective sealing engagement with the first check valve 292, which is adapted to provide one-way flow (from the first portion 330 to the second portion 332) through the first internal passage 328.

The first check valve seat 334 includes a generally frusto-conical surface that has an inner diameter that decreases as the distance from the second end surface 316 increases. However, the first check valve seat 334 may have other shapes, such as being horizontally flat. In the embodiment shown in FIGS. 8A and 8B, the first check valve seat 334 is generally perpendicular to a longitudinal axis that extends through the first internal passage 328, and is also generally perpendicular to the central longitudinal axis 266. However, the first check valve seat 334 may be configured at an angle to the central longitudinal axis 266.

The first internal passage 328 is in fluid communication with the first cavity 272 and the metering slot 326. Fluid communication between the metering slot 326 and the second portion 332 of the first internal passage 328 is established through the hole 324, which extends from the second circumferential surface 318 to the second portion 332 of the first internal passage 328.

The poppet body 294 of the poppet valve 290 further defines a second internal passage 329. The second internal passage 329 is configured to selectively provide fluid communication between the second cavity 274 (adjacent the first circumferential surface 304) and the load holding cavity 276 (adjacent the second end surface 316).

The second internal passage 329 extends in a generally longitudinal direction between the first circumferential surface 304 and the second end surface 316. In the poppet valve 290 shown, the second internal passage 329 is generally parallel to the central longitudinal axis 266 of the poppet body 294, and is offset from the central longitudinal axis 266. The second internal passage 329 shown is generally planar with the first internal passage 328 on the opposing side of the central longitudinal axis 266. However, the second internal passage 329 may be located in other portions of the poppet body 294.

The second internal passage 329 includes a first portion 331 and a second portion 333. The first portion 331 extends into the first axial portion 298 and is in fluid communication with the first circumferential surface 304 and the second cavity 274. The second portion 333 extends into the poppet body 294 from the second end surface 316.

The first portion 331 includes an inner diameter that is less than an inner diameter of the second portion 333. The first and second portions 331, 333 of the second internal passage 329 cooperatively define a second check valve seat 335. The second check valve seat 335 is configured for selective sealing engagement with the second check valve 293, which is adapted to provide one-way flow (from the first portion 331 to the second portion 333) through the second internal passage 329.

The second check valve seat 335 shown includes a generally frusto-conical surface that has an inner diameter that decreases as the distance from the second end surface 316 increases, but may also be horizontally flat. The second check valve seat 335 is generally perpendicular to a longitudinal axis that extends through the second internal passage 329, and is also generally perpendicular to the central longitudinal axis 266, but does not have to be perpendicular to the central longitudinal axis 266.

A linking passage 325, which may be an extension of the hole 324, connects the second portion 333 of the second internal passage 329 with the metering slot 326. Therefore, the second internal passage 329 provides checked fluid communication between the second cavity 274 and the metering slot 326.

Figure 3:
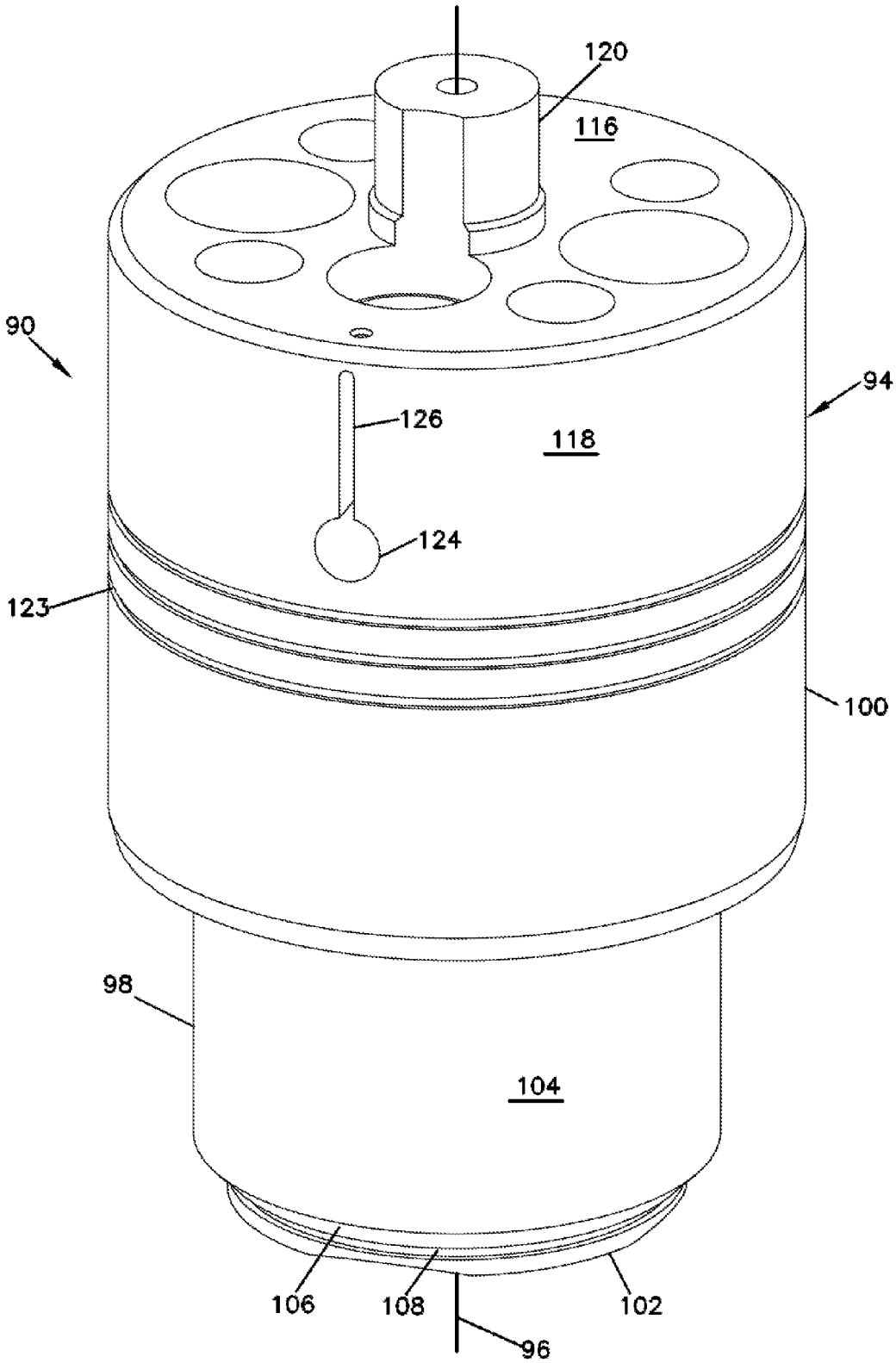
FIG. 3 is a schematic isometric view of a poppet valve suitable for use with the main stage valve assembly of FIG. 2.
Figure 4:
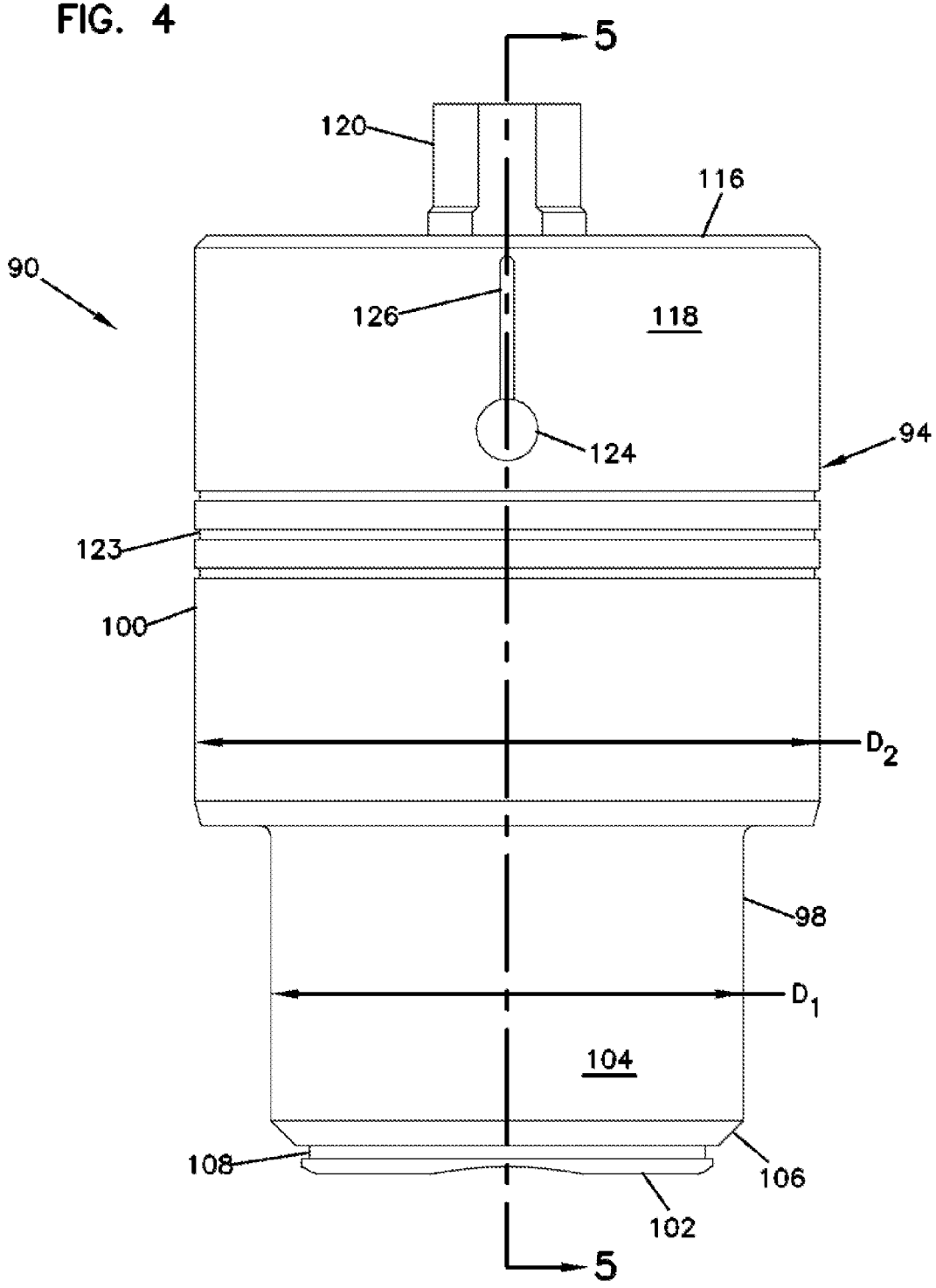
FIG. 4 is a schematic side view of the poppet valve of FIG. 3.
Figure 5:
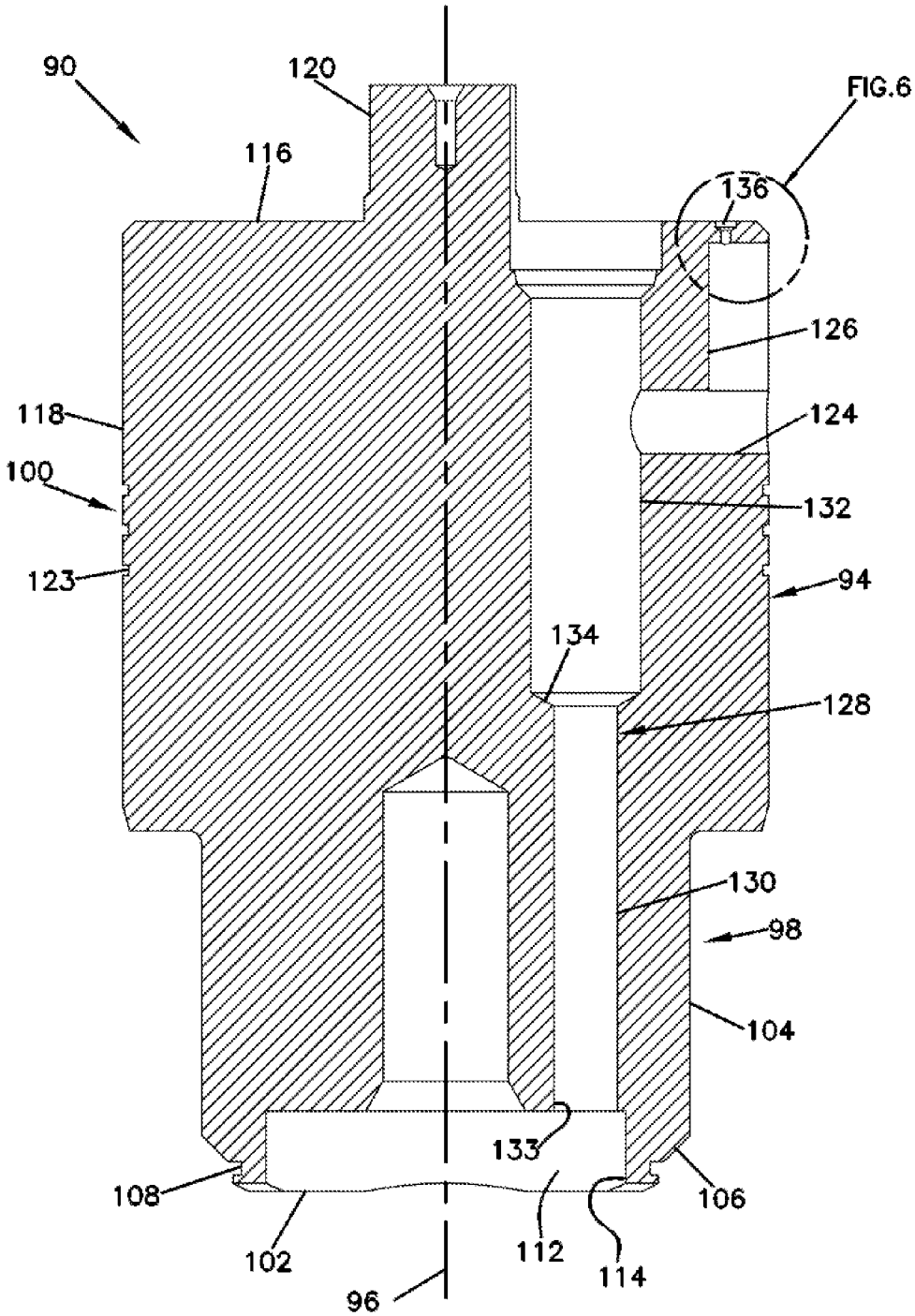
FIG. 5 is a schematic cross-sectional view of the poppet valve taken on line 5-5 of FIG. 4.

The poppet body 294 of the poppet valve 290 further defines an orifice 336. The orifice 336 extends through the second end surface 316 into the metering slot 326. An inner diameter of the orifice 336 is adapted to provide limited fluid communication between the metering slot 326 and the load holding cavity 276 when the poppet valve assembly 262 is in a seated position (as shown in FIGS. 3 and 2), such that the metering slot 326 is not directly in fluid communication with the load holding cavity 276.

The poppet valve assembly 262 closes by returning the poppet valve 290 to the valve seat 286 and stopping flow between the first cavity 272 and the second cavity 274. The closing movement is generally downward, as viewed in FIG. 8A.

Pressure differentials between the first cavity 272 and the load holding cavity 276 will cause the first check valve 292 in the first internal passage 328 to open and allow fluid flow from the first cavity 272 to the metering slot 326 and the load holding cavity 276. Similarly, pressure differentials between the second cavity 274 and the load holding cavity 276 will cause the second check valve 293 in the second internal passage 329 to open and allow fluid flow from the second cavity 274 to the metering slot 326 and the load holding cavity 276.

Depending upon the position of the poppet body 294, flow may occur directly between the metering slot 326 and the load holding cavity 276 or may pass through the orifice 336 if the metering slot 326 is blocked by the valve housing 260. Allowing flow through the second internal passage 329 may increase the closing speed (or response time) of the poppet valve assembly 262 as the poppet valve 290 moves into contact with the valve seat 286 when pressure in the second cavity 274 is higher than pressure in the first cavity 272.

Figure 9A:
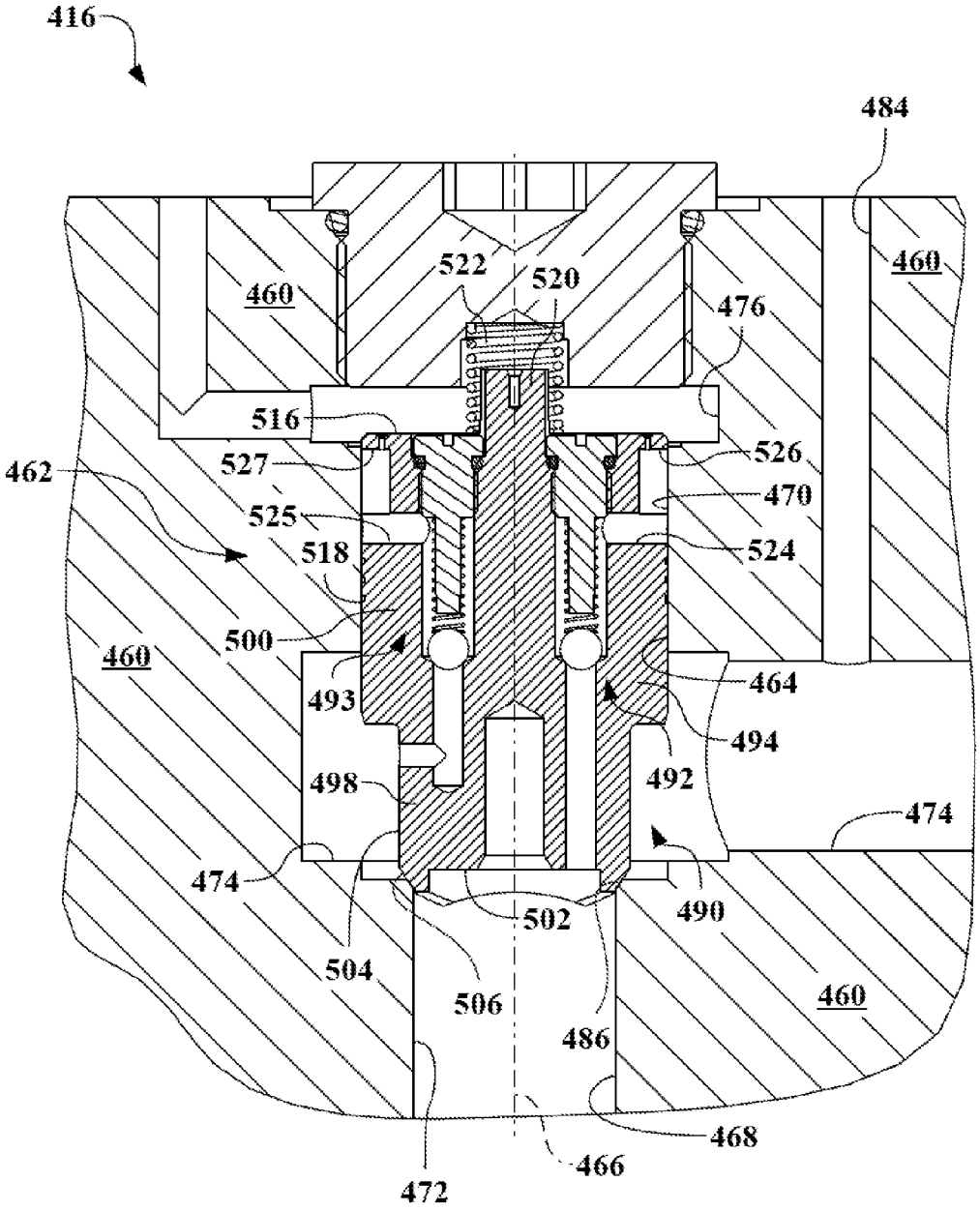
FIG. 9A is a schematic cross-sectional view of a main stage valve assembly including a poppet valve assembly having two check valves linked to respective orifices and metering slots.
Figure 9B:
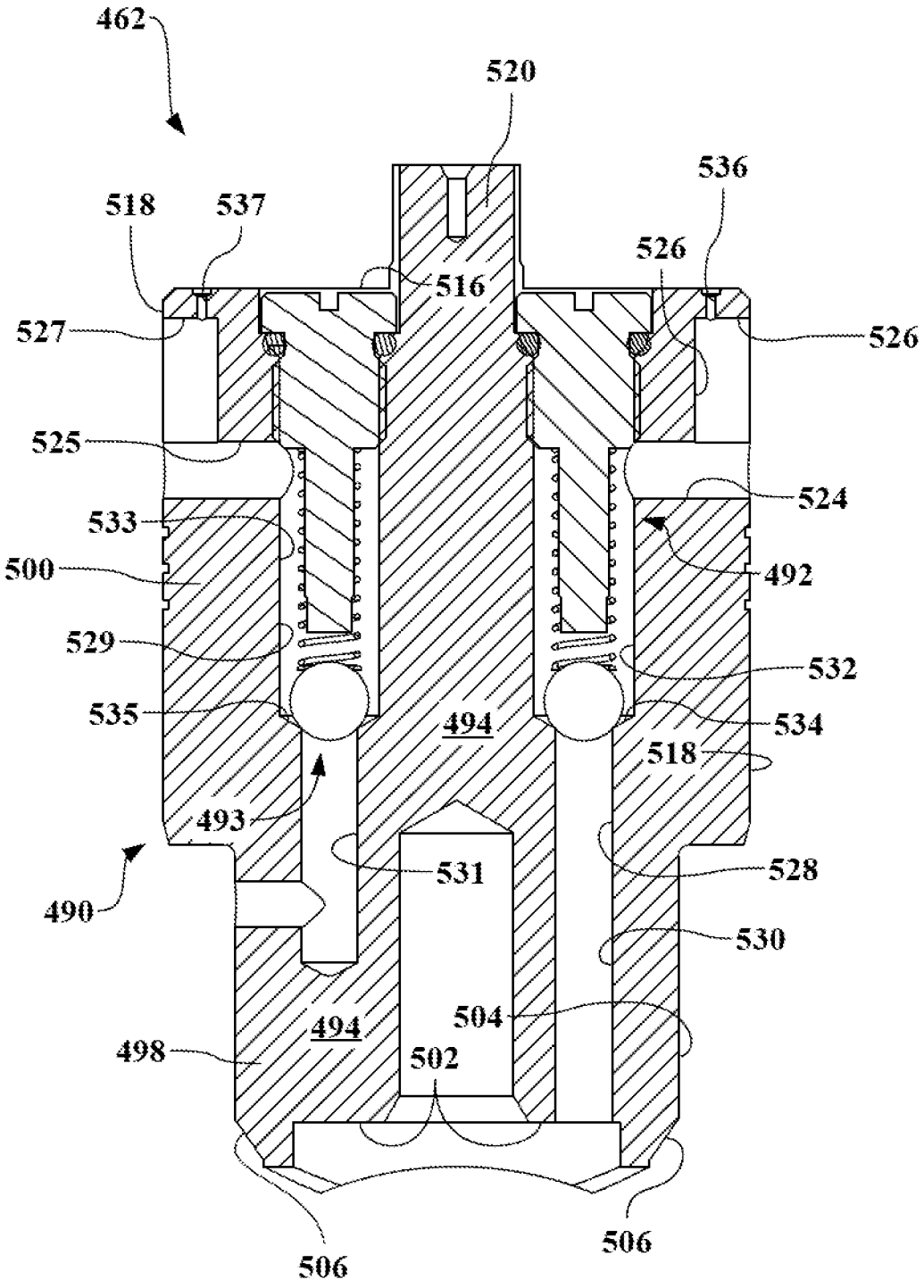
FIG. 9B is a schematic cross-sectional view of the poppet valve assembly shown in FIG. 9A.

Referring now to FIG. 9A and FIG. 9B, and with continued reference to FIGS. 1-8B, there is shown a main stage valve assembly 416. The main stage valve assembly 416 includes a valve housing 460 and a poppet valve assembly 462. FIG. 9A shows the whole main stage valve assembly 416, and FIG. 9B shows a larger view of the poppet valve assembly 462. Some of the features and aspects of the main stage valve assembly 416 are similar to the main stage valve assembly 216 shown in FIGS. 8A and 8B. Features and components shown in other figures may be incorporated and used with those shown in FIGS. 9A and 9B.

The valve housing 460 defines a valve bore 464 having a central longitudinal axis 466. The valve bore 464 is adapted to receive the poppet valve assembly 462. The poppet valve assembly 462 is adapted to move in an axial direction in the valve bore 464 along the central longitudinal axis 466.

The valve bore 464 includes a first end portion 468 and an oppositely disposed second end portion 470. The valve bore 464 defines a first cavity 472, a second cavity 474 and a load holding cavity 476. The first cavity 472 is disposed at the first end portion 468 of the valve bore 464. The second cavity 474 is disposed between the first end portion 468 and the second end portion 470. The load holding cavity 476 is disposed at the second end portion 470.

The valve housing 460 further defines a fourth fluid passage 484. The fourth fluid passage 484 is in fluid communication with the second cavity 474 and in selective fluid communication with the load holding cavity 476 through a control valve, which may be similar to the middle stage valve assembly 14 shown in FIG. 1. The first cavity 472 may be an inlet fluid passage and the second cavity 474 may be an outlet fluid passage.

The valve bore 464 includes a valve seat 486. The valve seat 486 is disposed at the first end portion 468 of the valve bore 464. The valve seat 486 is generally disposed at an intersection of the first cavity 472 and the valve bore 464.

The valve seat 486 of the valve bore 464 is adapted for selective sealing engagement with the poppet valve assembly 462. The valve seat 486 shown in FIG. 8 is tapered such that the valve seat 486 includes an inner diameter that decreases as the distance along the central longitudinal axis 466 from the valve seat 486 to the second end portion 470 increases. The valve seat 486 may be generally frusto-conical in shape.

The poppet valve assembly 462 includes a poppet valve 490, a first check valve 492, and a second check valve 493. The first check valve 492 and the second check valve 493 are disposed within the poppet valve 490.

The poppet valve 490 includes a poppet body 494, which is substantially coaxial with the central longitudinal axis 466 that extends through the center of the valve bore 464. The poppet body 494 includes a first axial end portion 498 and an oppositely disposed second axial end portion 500. The first axial end portion 498 has a first outer diameter that is less than a second outer diameter of the second axial end portion 500.

The first axial end portion 498 includes a first end surface 502 and a first circumferential surface 504. The first circumferential surface 504 is generally cylindrical in shape. The first circumferential surface 504 includes a tapered surface 506, which is adapted for selective sealing engagement with the valve seat 486 of the valve bore 464. The tapered surface 506 is disposed adjacent to the first end surface 502 and may be generally frusto-conical in shape.

The second axial end portion 500 includes a second end surface 516 and a second circumferential surface 518. As shown, the second end surface 516 may include a spring guide 520. The spring guide 520 is generally cylindrical in shape and extends outwardly from a central location on the second end surface 516. An outer diameter of the spring guide 520 is sized to be smaller than an inner diameter of a spring 522, such that the spring guide 520 fits within a portion of the inner diameter of the spring 522. The second circumferential surface 518 is also generally cylindrical in shape.

The second circumferential surface 518 defines a first hole 524 and a second hole 525 that extend into the poppet body 494 from the second circumferential surface 518 in a radial direction. The first hole 524 and the second hole 525 do not intersect each other. The second circumferential surface 518 further defines a first metering slot 526 and a second metering slot 527 that extend outwardly in an axial direction from the first hole 524 toward the second end surface 516. In the poppet valve 490 shown, the first metering slot 526 and the second metering slot 527 do not intersect the second end surface 516.

The poppet body 494 of the poppet valve 490 defines a first internal passage 528. The first internal passage 528 is configured to selectively provide fluid communication between the first cavity 472 (adjacent the first end surface 502) and the load holding cavity 476 (adjacent the second end surface 516). Fluid flow through the first internal passage 528 and flow through the control valve (such as a middle-stage valve) cooperatively determine the axial position of the poppet valve assembly 462 in the valve bore 464 of the valve housing 460.

The first internal passage 528 extends in a generally longitudinal direction between the first end surface 502 and the second end surface 516. In the poppet valve 490 shown, the first internal passage 528 is generally parallel to the central longitudinal axis 466 of the poppet body 494, and is offset from the central longitudinal axis 466.

The first internal passage 528 includes a first portion 530 and a second portion 532. The first portion 530 extends to the first end surface 502 and is in fluid communication with the first cavity 472. The second portion 532 extends into the poppet body 494 from the second end surface 516.

The first portion 530 includes an inner diameter that is less than an inner diameter of the second portion 532. The first and second portions 530, 532 of the first internal passage 528 cooperatively define a first check valve seat 534. The first check valve seat 534 is configured for selective sealing engagement with the first check valve 492, which is adapted to provide one-way flow (from the first portion 530 to the second portion 532) through the first internal passage 528.

The first check valve seat 534 shown includes a generally frusto-conical surface that has an inner diameter that decreases as the distance from the second end surface 516 increases. The first check valve seat 534 is generally perpendicular to a longitudinal axis that extends through the first internal passage 528, and is also generally perpendicular to the central longitudinal axis 466. However, the first check valve seat 534 may have a generally flat surface and does not have to be perpendicular to the central longitudinal axis 466.

The first internal passage 528 is in fluid communication with the first cavity 472 and the first metering slot 526. Fluid communication between the first metering slot 526 and the second portion 532 of the first internal passage 528 is established through the first hole 524, which extends from the second circumferential surface 518 to the second portion 532 of the first internal passage 528.

The poppet body 494 of the poppet valve 490 further defines a second internal passage 529. The second internal passage 529 is configured to selectively provide fluid communication between the second cavity 474 (adjacent the first circumferential surface 504) and the load holding cavity 476 (adjacent the second end surface 516).

The second internal passage 529 extends in a generally longitudinal direction between the first circumferential surface 504 and the second end surface 516. In the poppet valve 490 shown, the second internal passage 529 is generally parallel to the central longitudinal axis 466 of the poppet body 494, and is offset from the central longitudinal axis 466. The second internal passage 529 shown is generally planar with the first internal passage 528 on the opposing side of the central longitudinal axis 466. However, the second internal passage 529 may be located in other portions of the poppet body 494.

The second internal passage 529 includes a first portion 531 and a second portion 533. The first portion 531 extends into the first axial portion 498 and is in fluid communication with the first circumferential surface 504 and the second cavity 474. The second portion 533 extends into the poppet body 494 from the second end surface 516 and is also in communication with the second metering slot 527.

The first portion 531 includes an inner diameter that is less than an inner diameter of the second portion 533. The first and second portions 531, 533 of the second internal passage 529 cooperatively define a second check valve seat 535. The second check valve seat 535 is configured for selective sealing engagement with the second check valve 493, which is adapted to provide one-way flow (from the first portion 531 to the second portion 533) through the second internal passage 529.

The second check valve seat 535 shown includes a generally frusto-conical surface that has an inner diameter that decreases as the distance from the second end surface 516 increases. The second check valve seat 535 shown is generally perpendicular to a longitudinal axis that extends through the second internal passage 529, and is also generally perpendicular to the central longitudinal axis 466. However, the second check valve seat 535 may have a generally flat surface or other shaped surface and may not be perpendicular to the central longitudinal axis 466.

The second hole 525 connects the second portion 533 of the second internal passage 529 with the second metering slot 527. Therefore, the second internal passage 529 provides selective, one-way, fluid communication between the second cavity 474 and the second metering slot 527.

The poppet body 494 of the poppet valve 490 defines a first orifice 536, which extends through the second end surface 516 into the first metering slot 526. An inner diameter of the first orifice 536 is adapted to provide limited fluid communication between the first metering slot 526 and the load holding cavity 476 when the poppet valve assembly 462 is in or near a seated position (as shown in FIGS. 1 and 2), such that the first metering slot 526 is not directly in fluid communication with the load holding cavity 476.

The poppet body 494 of the poppet valve 490 defines a second orifice 537, which extends through the second end surface 516 into the second metering slot 527. An inner diameter of the second orifice 537 is adapted to provide limited fluid communication between the second metering slot 527 and the load holding cavity 476 when the poppet valve assembly 462 is in or near a seated position (as shown in FIGS. 1 and 2), such that the second metering slot 527 is not directly in fluid communication with the load holding cavity 476.

The poppet valve assembly 462 closes by returning the poppet valve 490 to the valve seat 486 and stopping flow between the first cavity 472 and the second cavity 474. The closing movement is generally downward, as viewed in FIG. 9A.

Pressure differentials between the first cavity 472 and the load holding cavity 476 will cause the first check valve 492 in the first internal passage 528 to open and allow fluid flow from the first cavity 472 to the first metering slot 526 and the load holding cavity 476. Similarly, pressure differentials between the second cavity 474 and the load holding cavity 476 will cause the second check valve 493 in the second internal passage 529 to open and allow fluid flow from the second cavity 474 to the second metering slot 527 and the load holding cavity 476.

Depending upon the position of the poppet body 494, flow may occur directly between the first and second metering slots 526, 527 and the load holding cavity 476 or flow may pass through the first and second orifices 536, 537 if the first and second metering slots 526, 527 are blocked by the housing 460. Allowing additional flow through the second internal passage 529 directly between the second cavity 474 and the load holding cavity 476 may increase the closing speed (or response time) of the poppet valve assembly 462 as the poppet valve 490 moves into contact with the valve seat 486 when pressure at the second cavity 474 is higher than pressure at the first cavity 472.

The detailed description and the drawings or figures are supportive and descriptive of the invention, but the scope of the invention is defined solely by the claims. While the best mode, if known, and other embodiments for carrying out the claimed invention have been described in detail, various alternative designs and embodiments exist for practicing the invention defined in the appended claims.

The invention claimed is:

1. A poppet valve assembly, comprising:

a body including:

a first axial end portion having a first circumferential surface, a first end surface, and a tapered surface configured for sealing engagement with a main valve seat;

a second axial end portion opposite the first axial end portion;

a metering slot defined by the second axial end portion;

a first internal passage defined by the body, wherein the first internal passage includes an opening in the first end surface, is in fluid communication with the metering slot, and has a first check valve seat; and a second internal passage defined by the body, wherein the second internal passage includes an opening in the first circumferential surface, is in fluid communication with the metering slot, and has a second check valve seat;

a first check valve disposed in the first internal passage and adapted for sealing engagement with the first check valve seat; and a second check valve disposed in the second internal passage and adapted for sealing engagement with the second check valve seat;

wherein the second axial end portion has a second circumferential surface and a second end surface, wherein the metering slot is in fluid communication with the second circumferential surface, and wherein the second end surface defines a first orifice in fluid communication with the metering slot.

2. The poppet valve assembly of claim 1, wherein the first check valve is biased into engagement with the first check valve seat by a first check spring, such that checked flow occurs between the first end surface and the metering slot, and wherein the second check valve is biased into engagement with the second check valve seat by a second check spring, such that checked flow occurs between the first circumferential surface and the metering slot.

3. The poppet valve assembly of claim 2, wherein the first internal passage is offset from a central longitudinal axis of the body, and wherein the second internal passage is offset from the central longitudinal axis of the body.

4. The poppet valve assembly of claim 3, wherein the first axial end portion has a first outer diameter that is less than a second outer diameter of the second axial end portion.

5. The poppet valve assembly of claim 4, wherein the metering slot is a first metering slot and is in fluid communication with the first internal passage but is not in fluid communication with the second internal passage, wherein the second axial end portion defines a second metering slot, and wherein the second internal passage is in fluid communication with the second metering slot.

6. The poppet valve assembly of claim 5, wherein the second metering slot is in fluid communication with the second circumferential surface, and wherein the second end surface defines a second orifice in fluid communication with the second metering slot.

7. A poppet valve assembly, comprising:

a body including:

a first axial end portion, wherein the first axial end portion has a first circumferential surface, a first end surface, and a tapered surface configured for sealing engagement with a main valve seat;

a second axial end portion opposite the first axial end portion, wherein the second axial end portion has a second circumferential surface and a second end surface;

a first metering slot defined by the second axial end portion;

a second metering slot defined by the second axial end portion;

a first internal passage defined by the body, wherein the first internal passage includes an opening in the first end surface, is in fluid communication with the first metering slot, and has a first check valve seat; and a second internal passage defined by the body, wherein the second internal passage includes an opening in the first circumferential surface, is in fluid communication with the second metering slot, and has a second check valve seat;

a first check valve disposed in the first internal passage and adapted for sealing engagement with the first check valve seat; and a second check valve disposed in the second internal passage and adapted for sealing engagement with the second check valve seat;

wherein the first metering slot and the second metering slot are in fluid communication with the second circumferential surface, wherein the second end surface defines a first orifice in fluid communication with the first metering slot, and wherein the second end surface defines a second orifice in fluid communication with the second metering slot.

8. The poppet valve assembly of claim 7, wherein the first axial end portion has a first outer diameter that is less than a second outer diameter of the second axial end portion.

9. The poppet valve assembly of claim 8, wherein the first check valve is biased into engagement with the first check valve seat by a first check spring, such that checked flow occurs between the first end surface and the first metering slot, and wherein the second check valve is biased into engagement with the second check valve seat by a second check spring, such that checked flow occurs between the first circumferential surface and the second metering slot.

10. A valve assembly, comprising:

a housing, defining:

a first cavity;

a second cavity;

a load holding cavity in selective fluid communication with the second cavity; and a valve bore having a main valve seat, the valve bore being in fluid communication with the first cavity, the second cavity, and the load holding cavity, wherein the valve seat is disposed in the valve bore between the first and second cavities; and a poppet valve assembly disposed in the valve bore, the poppet valve assembly including:

a poppet body, including:

a first axial end portion having a first circumferential surface, a first end surface, and a tapered surface configured for sealing engagement with the main valve seat;

a second axial end portion opposite the first axial end portion;

a metering slot defined by the second axial end portion;

a first internal passage defined by the poppet body, wherein the first internal passage includes an opening in the first end surface, is in fluid communication with the metering slot, and has a first check valve seat; and a second internal passage defined by the poppet body, wherein the second internal passage includes an opening in the first circumferential surface, is in fluid communication with the metering slot, and has a second check valve seat;

a first check valve disposed in the first internal passage and adapted for sealing engagement with the first check valve seat; and a second check valve disposed in the second internal passage and adapted for sealing engagement with the second check valve seat wherein the second axial end portion of the poppet body has a second circumferential surface and a second end surface, wherein the metering slot is defined in the second circumferential surface and is in fluid communication with the load holding cavity of the housing, and wherein the second end surface defines a first orifice in fluid communication with the metering slot.

11. The valve assembly of claim 10, further comprising a control valve, wherein the control valve selectively places the load holding cavity in fluid communication with the second cavity.

12. The valve assembly of claim 11, wherein the metering slot is a first metering slot and is in fluid communication with the first internal passage but is not in fluid communication with the second internal passage, wherein the second axial end portion defines a second metering slot, and wherein the second internal passage is in fluid communication with the second metering slot.

13. The valve assembly of claim 12, wherein the second metering slot is defined in the second circumferential surface and is in fluid communication with the load holding cavity of the housing, and wherein the second end surface defines a second orifice in fluid communication with the second metering slot.

* * * * *